US010309264B2

(12) United States Patent
Choi et al.

(10) Patent No.: US 10,309,264 B2
(45) Date of Patent: Jun. 4, 2019

(54) ROLLER FINGER FOLLOWER

(71) Applicants: Hyundai Motor Company, Seoul (KR); Kia Motors Corporation, Seoul (KR)

(72) Inventors: Myungsik Choi, Seoul (KR); Younghong Kwak, Suwon-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 15/794,852

(22) Filed: Oct. 26, 2017

(65) Prior Publication Data

US 2018/0334929 A1 Nov. 22, 2018

(30) Foreign Application Priority Data

May 16, 2017 (KR) ..... 10-2017-0060523

(51) Int. Cl.
*F01L 1/18* (2006.01)
*F01L 1/26* (2006.01)

(52) U.S. Cl.
CPC ..... *F01L 1/181* (2013.01); *F01L 1/185* (2013.01); *F01L 1/26* (2013.01); *F01L 2105/00* (2013.01)

(58) Field of Classification Search
CPC ..... F01L 1/181; F01L 1/26; F01L 2105/00; F01L 1/185
See application file for complete search history.

(56) References Cited

U.S. PATENT DOCUMENTS 5,010,856 A * 4/1991 Ojala ..... F01L 1/185 123/90.36
2010/0307437 A1 12/2010 Kamm et al.

FOREIGN PATENT DOCUMENTS

JP 2002-266610 A 9/2002

* cited by examiner

*Primary Examiner* — Zelalem Eshete
(74) *Attorney, Agent, or Firm* — Morgan, Lewis & Bockius LLP

(57) ABSTRACT

A vehicle roller finger follower may include a main body including a supporting portion and a wall portion having one end portion integrally extending in a width direction of the supporting portion at both sides; and a pallet portion formed toward an outside in the width direction of the main body at the other end portion of the wall portion, wherein the wall portion has a mounting hole to mount a bearing, and a connection portion is formed at a lower portion of the wall portion at a position corresponding to the mounting hole.

11 Claims, 4 Drawing Sheets

ROLLER FINGER FOLLOWER

CROSS-REFERENCE TO RELATED APPLICATION

The present application claims priority to Korean Patent Application No. 10-2017-0060523 filed on May 16, 2017, the entire contents of which is incorporated herein for all purposes by this reference.

BACKGROUND OF THE INVENTION

Field of the Invention

The present invention relates to a vehicle roller finger follower. More particularly, the present invention relates to a vehicle roller finger follower provided in a valve mechanism of an internal combustion engine.

Description of Related Art

In general, internal combustion engines generate power by receiving and burning air and fuel in a combustion chamber. In the instant case, when the air is drawn in, an intake valve is operated by driving a camshaft, to draw the air into the combustion chamber while the intake valve is opened. When the air is exhausted, an exhaust valve is operated by driving the camshaft to exhaust the air from the combustion chamber while the exhaust valve is opened.

An optimum operation of the intake valve or the exhaust valve varies depending on a rotation speed of the engine. That is, depending on the rotation speed of the engine, an appropriate lift or valve opening or closing time is controlled.

Here, the opening or closing of the valve is performed through a roller finger follower of a valve train, and the roller finger follower is operated by the cam linked to the rotational movement of the crankshaft that is rotated by receiving a power generated by the combust of the fuel.

The roller finger follower is manufactured by a stamping method using a press molding to reduce a cost. This roller finger follower includes a body portion mounted with a bearing to be in contact with the cam and a pallet portion integrally connected to the body portion and in contacted with the valve.

However, in the conventional roller finger follower, because a cross-section that the body portion and the pallet portion are connected is small, it is difficult to disperse a load transmitted from the valve, a durability deterioration and a fatigue failure between the body portion and the pallet portion are generated due to an accumulation of the load.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a vehicle roller finger follower efficiency dispersing a load transmitted from a bearing and valve an minimizing a fatigue failure generation in the pallet portion.

A vehicle roller finger follower according to an exemplary embodiment of the present invention includes a main body including a supporting portion and a wall portion having one end portion integrally extending in a width direction of the supporting portion at both sides; and a pallet portion formed toward an outside in the width direction of the main body at the other end portion of the wall portion, wherein the wall portion has a mounting hole to mount a bearing, and a connection portion is formed at a lower portion of the wall portion at a position corresponding to the mounting hole.

The connection portion may integrally extend toward a lower portion from the wall portion.

One end portion of the connection portion may be integrally connected to the supporting portion.

The connection portion may be formed of a cross-section having a t⊏" he connection pa.

The other end portion of the connection portion may be formed to be inclined downward by a predetermined angle θ1 from the supporting portion toward the pallet portion with reference to an imaginary horizontal line L passing through the supporting portion and a lower portion of the pallet portion.

The pallet portion may extend from an external surface of the wall portion.

The pallet portion may be bent from one end portion connected to the wall portion to the other end portion.

The lower surface of the protruded end portion of the pallet portion may be formed of a valve contacting surface protruded to be rounded toward the lower portion.

The wall portion may be bent vertically toward the upper portion of the supporting portion.

The main body, the pallet part, and the connection portion may be integrally formed.

The bearing may be mounted to the mounting hole through a connection shaft to be rotatable.

As above-described, according to an exemplary embodiment of the present invention, as the connection portion is integrally formed to support the load transmitted to the bearing and the contact area of the pallet portion connected to the wall portion of the main body increases, the load transmitted from the valve and the load transmitted to the bearing may be efficiency dispersed and the fatigue failure generation may be minimized in the pallet portion.

Also, as a durability of the roller finger follower increases, the productivity may be improved, and the roller finger follower is manufactured by the stamping method to operate two valves as one mechanism such that the cost may be reduced.

As a durability of the roller finger follower increases, the productivity may be improved, the stamping method is maintained such that the cost reduction may be obtained.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
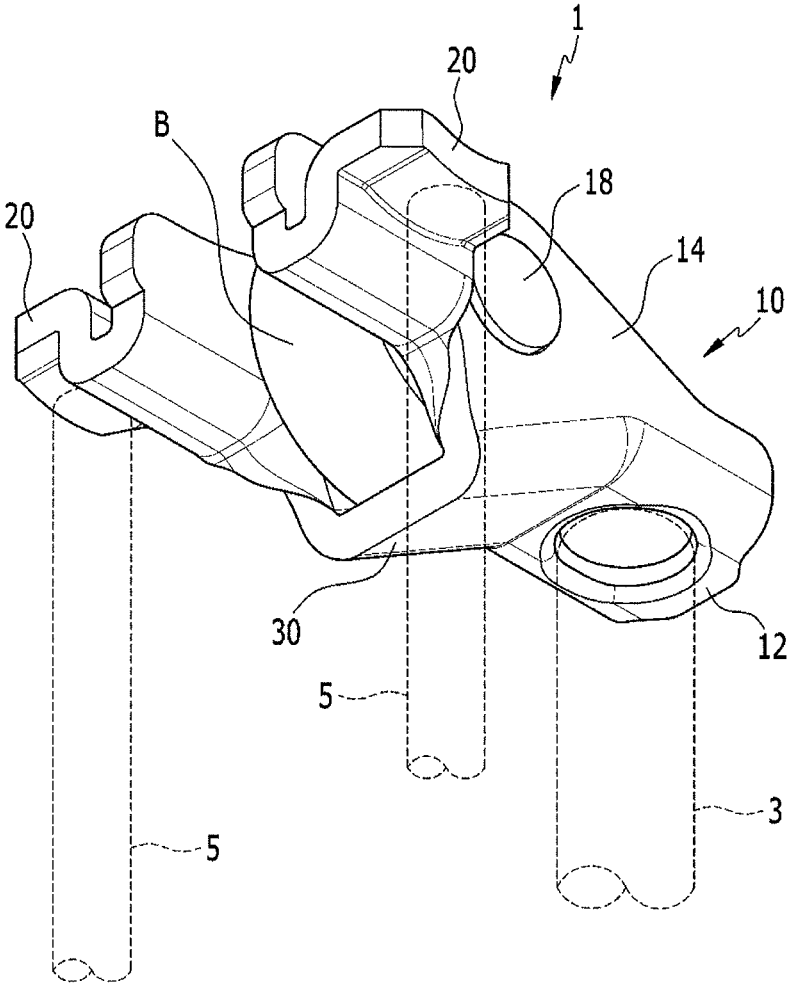
FIG. 1 is a schematic diagram of a valve train to which a vehicle roller finger follower according to an exemplary embodiment of the present invention is applied.

It may be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

First, since the exemplary embodiment described in the specification and the configurations shown in the drawings are merely the most preferable exemplary embodiment and configurations of the present invention, they do not represent all of the technical ideas of the present invention, and it should be understood that that various equivalents and modified examples, which may replace the exemplary embodiments, are possible when filing the present application.

To clearly describe the present invention, parts that are irrelevant to the description are omitted, and identical or similar constituent elements throughout the specification are denoted by the same reference numerals.

Since the size and thickness of each configuration shown in the drawings are arbitrarily shown for convenience of description, the present invention is not necessarily limited to configurations illustrated in the drawings, and to clearly illustrate several parts and areas, enlarged thicknesses are shown.

Moreover, throughout the specification, unless explicitly described to the contrary, the word "comprise" and variations such as "comprises" or "comprising" will be understood to imply the inclusion of stated elements but not the exclusion of any other elements.

Furthermore, terms such as "unit", "means", "part", and "member" described in the specification mean a unit of a comprehensive configuration having at least one function or operation.

Figure 2:
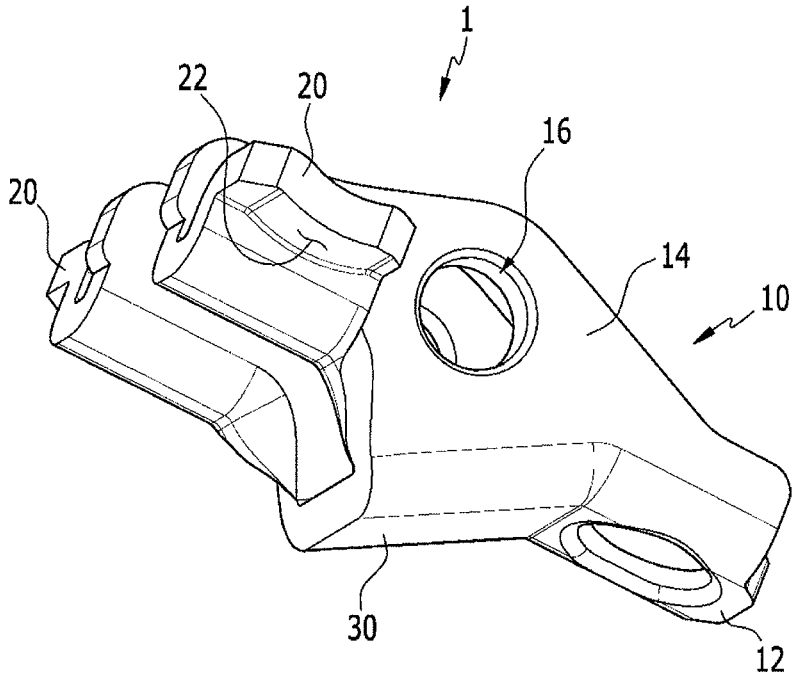
FIG. 2 is a perspective view of a vehicle roller finger follower according to an exemplary embodiment of the present invention.
Figure 3:
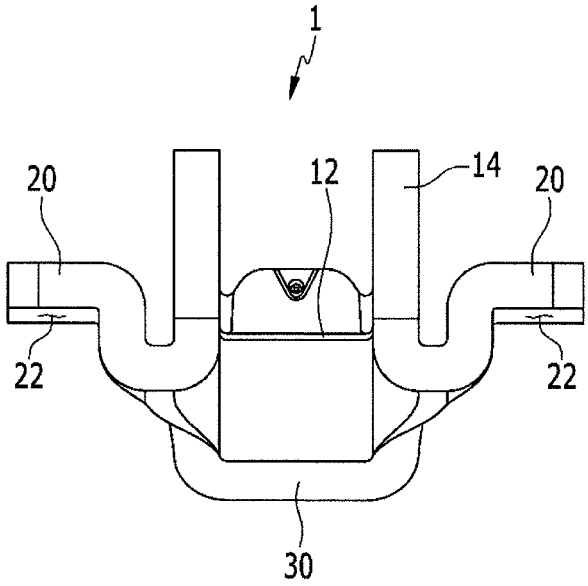
FIG. 3 is a side view of a vehicle roller finger follower according to an exemplary embodiment of the present invention.
Figure 4:
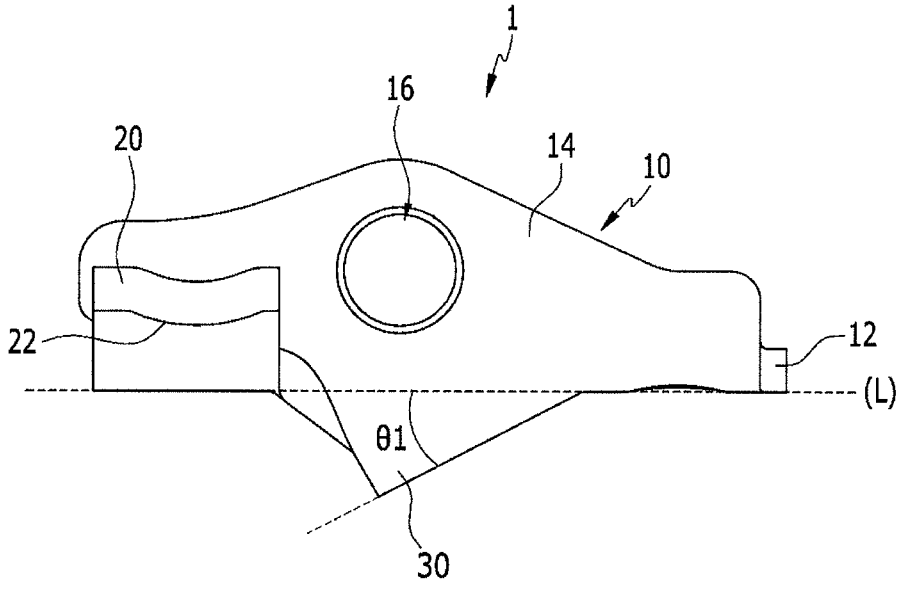
FIG. 4 is a front view of a vehicle roller finger follower according to an exemplary embodiment of the present invention.

FIG. 1 is a schematic diagram of a valve train to which a vehicle roller finger follower according to an exemplary embodiment of the present invention is applied, FIG. 2 is a perspective view of a vehicle roller finger follower according to an exemplary embodiment of the present invention, FIG. 3 is a side view of a vehicle roller finger follower according to an exemplary embodiment of the present invention, and FIG. 4 is a front view of a vehicle roller finger follower according to an exemplary embodiment of the present invention.

Referring to FIG. 1, a vehicle roller finger follower 1 according to an exemplary embodiment of the present invention is applied to operate a valve 5 for an intake or an exhaust of an engine.

In the instant case, the roller finger follower 1 is manufactured to operate two valve 5 as one mechanism.

The roller finger follower 1, as shown in FIG. 2, FIG. 3 and FIG. 4, includes a main body 10, a pallet portion 20, and a connection portion 30.

Firstly, the main body 10 includes a supporting portion 12 and a wall portion 14.

A pivot 3 as a rash adjuster controlling an interval of the roller finger follower 1 and the valve 5 may be mounted under the supporting portion 12.

Each of one end portion of the wall portion 14 is integrally extending at both sides in a width direction of the supporting portion 12 and is bent from the supporting portion 12. Here, the wall portion 14 may be bent vertically toward an upper portion of the supporting portion 12.

In the exemplary embodiment of the present invention, the pallet portion 20 is formed toward an outside in the width direction of the main body 10 at the other end portion of the wall portion 14.

In the wall portion 20, a mounting hole 16 is formed to mount the bearing B.

The bearing B may be mounted to the mounting hole 16 through the connection shaft 18 to be rotatable.

Accordingly, while the bearing B is smoothly in cam-contact with a camshaft, the bearing B may operate the valve 5 through the pallet portion 20 of the roller finger follower 1.

On the other hand, the pallet portion 20 extends from an external surface of the wall portion 14. Accordingly, the pallet portion 20 is contact with the external surface of the wall portion 14 by a width length, increasing a contact area with the main body 10.

Therefore, as the pallet portion 20 sufficiently ensures the contact area with the wall portion 14, the load transmitted from the valve 5 may be efficiency dispersed to the wall portion 14. Also, the pallet portion 20 may minimize a generation of a fatigue failure due to an accumulation of the repeatedly transmitted load.

This pallet portion 20 may be bent from one end portion connected to the wall portion 14 to the other end portion.

Also, the lower surface of the protruded end portion of the pallet portion 20 is formed of a valve contacting surface 22 that protrudes to be rounded toward a lower portion.

Accordingly, when the roller finger follower 1 is lever-moved, as the pallet portion 20 is in contact with the valve 5 through the valve contacting surface 22, a friction with the valve 5 may be minimized.

Also, the connection portion 30 is formed under each wall portion 14 at the position corresponding to the mounting hole 16 to support the load transmitted to the main body 10 from the bearing B.

Here, the connection portion 30 may integrally extend toward the lower portion from the wall portion 14. Also, one end portion of the connection portion 30 may be integrally connected to the supporting portion 12.

The connection portion 30 may form a cross-section having a "⊏" character shape that both ends are respectively bent toward the upper portion.

Also, the other end portion of the connection portion 30 may be formed to be inclined downward by a predetermined angle θ1 from the supporting portion 12 toward the pallet portion 20 with reference to an imaginary horizontal line L passing through the supporting portion 12 and the lower portion of the pallet portion 20.

Accordingly, as the connection portion 30 prevents the contact with the bearing B and connects the lower portion of the wall portion 14, the load may be dispersed while efficiency supporting the load acted from the bearing B to the wall portion 14.

On the other hand, in the exemplary embodiment of the present invention, the connection portion 30 is formed of the slanted surface that is inclined downward toward the pallet portion 20 from the supporting portion 12 as an exemplary embodiment, however it is not limited thereto, the connection portion 30 may be protruded to be rounded to the lower portion of the wall portion 14.

The main body 10, the pallet portion 20, and the connection portion 30 that are configured in the present way may be integrally formed.

Accordingly, as above-described, when the vehicle roller finger follower 1 according to an exemplary embodiment of the present invention, as the connection portion 30 is integrally formed to support the load transmitted to the bearing B and the contact area of the pallet portion 20 connected to the wall portion 14 of the main body 10 increases, the load transmitted from the valve 5 and the load transmitted to the bearing B may be efficiency dispersed and the fatigue failure generation may be minimized in the pallet portion 20.

Also, as a durability of the roller finger follower 1 increases, the productivity may be improved, and the roller finger follower 1 is manufactured by the stamping method to operate two valves 5 as one mechanism such that the cost may be reduced.

While this invention has been described with reference to what is presently considered to be practical exemplary embodiments, it is to be understood that the invention is not limited to the disclosed embodiments, but, on the contrary, is intended to cover various modifications and equivalent arrangements included within the spirit and scope of the appended claims.

For convenience in explanation and accurate definition in the appended claims, the terms "upper", "lower", "internal", "outer", "up", "down", "upper", "lower", "upwards", "downwards", "front", "rear", "back", "inside", "outside", "inwardly", "outwardly", "internal", "external", "internal", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A vehicle roller finger follower apparatus comprising:

a main body including a supporting portion and a wall portion having a first end portion integrally extending in a width direction of the supporting portion at a first side and a second side thereof; and a pallet portion formed toward an outside in a width direction of the main body at a second end portion of the wall portion, wherein the wall portion has a mounting hole to mount a bearing, wherein a connection portion is formed at a lower portion of the wall portion at a position corresponding to the mounting hole, wherein a first end portion of the connection portion is formed to be inclined downward by a predetermined angle from the supporting portion toward the pallet portion with respect to an imaginary horizontal line passing through the supporting portion and a lower portion of the pallet portion, and wherein the connection portion connects the lower portion of the wall portion and prevents a contact thereof with the bearing so that a load is dispersed while the connection portion supports the load acted from the bearing to the wall portion.

2. The vehicle roller finger follower apparatus of claim 1, wherein the connection portion integrally extends toward a lower portion from the wall portion.

3. The vehicle roller finger follower apparatus of claim 1, wherein a second end portion of the connection portion is integrally connected to the supporting portion.

4. The vehicle roller finger follower apparatus of claim 1, wherein the connection portion is formed of a cross-section having a "⊏" character shape.

5. The vehicle roller finger follower apparatus of claim 1, wherein the pallet portion extends from an external surface of the wall portion.

6. The vehicle roller finger follower apparatus of claim 1, wherein the pallet portion is bent from a first end portion thereof connected to the wall portion to a second end portion thereof.

7. The vehicle roller finger follower apparatus of claim 1, wherein a lower surface of a protruded end portion of the pallet portion is formed of a valve contacting surface protruded to be rounded toward the lower portion.

8. The vehicle roller finger follower apparatus of claim 1, wherein the wall portion is bent vertically toward an upper portion of the supporting portion.

9. The vehicle roller finger follower apparatus of claim 1, wherein the main body, the pallet part, and the connection portion are integrally formed.

10. The vehicle roller finger follower apparatus of claim 1, wherein the bearing is mounted to the mounting hole through a connection shaft to be rotatable.

11. The vehicle roller finger follower apparatus of claim 1, wherein the first end portion of the connection portion is open toward the pallet portion along the imaginary horizontal line.

* * * * *